US006609774B2

(12) United States Patent
Banicevic et al.

(10) Patent No.: US 6,609,774 B2
(45) Date of Patent: Aug. 26, 2003

(54) REINFORCED REFRIGERATOR CABINET CLOSING DRAWER

(75) Inventors: Nedo Banicevic, Hamilton (CA); Muc Dang, Burlington (CA)

(73) Assignee: Camco Inc., Mississauga (CA)

( * ) Notice: Subject to any disclaimer, the term of this patent is extended or adjusted under 35 U.S.C. 154(b) by 0 days.

(21) Appl. No.: 10/352,093

(22) Filed: Jan. 28, 2003

(65) Prior Publication Data

US 2003/0111943 A1 Jun. 19, 2003

Related U.S. Application Data

(62) Division of application No. 09/963,626, filed on Sep. 27, 2001.

(30) Foreign Application Priority Data

Apr. 20, 2001 (CA) ..... 2344923

(51) Int. Cl.[7] ..... A47B 88/00

(52) U.S. Cl. ..... 312/330.1; 312/348.4; 312/404

(58) Field of Search ..... 312/330.1, 334.1, 312/334.7, 348.1, 348.2, 348.4, 401, 402, 404, 116; 62/382

(56) References Cited

U.S. PATENT DOCUMENTS

| | | | | |
|---|---|---|---|---|
| 2,104,939 A | | 1/1938 | Whalen | |
| 2,306,802 A | * | 12/1942 | Harbison | 312/404 X |
| 2,413,597 A | | 12/1946 | Armstrong | |
| 2,573,272 A | | 10/1951 | Petkwitz | |
| 2,682,754 A | | 7/1954 | Eck | |
| 3,024,075 A | * | 3/1962 | Howe | 312/348.4 |
| 4,013,434 A | | 3/1977 | Kronenberger et al. | |
| 4,107,833 A | | 8/1978 | Knight et al. | |
| 4,190,305 A | | 2/1980 | Knight et al. | |
| 4,448,464 A | | 5/1984 | Reichert et al. | |
| 4,462,645 A | | 7/1984 | Ballarin et al. | |
| 4,832,422 A | * | 5/1989 | Fortmann | 312/330.1 |
| 5,040,856 A | * | 8/1991 | Wilkins et al. | 312/402 |
| 5,366,284 A | | 11/1994 | Baker et al. | 312/404 |
| 5,366,285 A | * | 11/1994 | Borgen et al. | 312/404 |
| 5,486,045 A | | 1/1996 | Dasher | 312/406 |
| 5,893,620 A | | 4/1999 | Birgelis | 312/408 |
| 6,447,083 B1 | | 9/2002 | Chiapetta et al. | |

FOREIGN PATENT DOCUMENTS

| | | | | |
|---|---|---|---|---|
| CH | 460275 | * | 9/1968 | 312/348.4 |
| FR | 975649 | | 3/1951 | |

* cited by examiner

*Primary Examiner*—James O. Hansen

(57) ABSTRACT

A refrigerator with a pull out drawer has plastic cabinet and drawer liners and a closed reinforcing assembly mounted within the drawer and cabinet for supporting loads carried by the drawer. The assembly has a reinforcing brace secured within the drawer having two spaced apart wing members and a cross member connected to and extending between the wing members adjacent an inside surface of the inner liner. The assembly has a pair of telescopically extendable guide rails each mounted to one of the opposing liner side walls of the cabinet and the through the liner of the drawer to support the drawer for relative movement with the cabinet. The cabinet has a pair of reinforcing bracket members located therein each having a side reinforcing portion extending adjacent a corresponding one of the guide rails and mounted to the liner side wall by fasteners passing through the guide rails and liner side walls. The reinforcing bracket members each having a rear wall portion extending orthogonal from the respective side reinforcing portions adjacent to and in contact with the rear wall of the interior liner secured to each other to form a continuous arm to interconnect and reinforce the side reinforcing portions. The closed reinforcing assembly comprising the reinforcing brackets, the guide rails and the reinforcing brace provide a closed loop rectangular reinforcing structure for loads carried by the guide rails and drawer.

26 Claims, 7 Drawing Sheets

REINFORCED REFRIGERATOR CABINET CLOSING DRAWER

This application is a divisional application of U.S. patent application Ser. No. 09/963,626 filed Sep. 27, 2001, entitled "REINFORCED REFRIGERATOR CABINET CLOSING DRAWER" still pending.

BACKGROUND OF THE INVENTION

1. Field of the Invention

The present invention relates generally to structural supports for use in refrigerator cabinets employing polyurethane foam insulation and, more particularly, to supports which may be used for supporting a pull out drawer that closes an open front of a refrigerator.

2. Description of the Prior Art

In the art of refrigerator cabinet construction, particularly where plastic inner liners are employed, it is frequently necessary to provide selective reinforcement because the plastic liner walls are not strong enough to carry shelf load even when the walls are foamed in place. For example, where shelf supports or the like are attached to the inner liner, particularly a plastic inner liner, some form of support is needed. A screw receiving aperture in the plastic is generally unsatisfactory, except where extremely light loads are involved, because insufficient area for thread engagement results and the entire load is concentrated on a very small portion of the plastic material. These factors contribute to premature undesirable deformation or cracking of the plastic sheet.

In a typical refrigerator construction, metallic plates are used generally as stiffening members where needed. In a more specific application, where a load such as a shelf is to be applied to a plastic inner liner, metallic or plastic back plates are employed.

Another type of local stiffener support is disclosed in U.S. Pat. No. 4,190,305 issued Feb. 26, 1980 and 4,107,833 issued Aug. 22, 1978 to Knight et al. These patents teach the use of a fibrous material behind the inner wall of the refrigerator cabinet to locally reinforce the cabinet. The material is compatible with polyurethane foam insulation.

Where exceptionally heavy loads must be applied to the inner liner, a separate metallic or molded plastic member may be employed which actually bridges between the inner liner and the outer case to transmit the applied interior load directly to the metal outer case. However, such members may act as a thermal conductor between the inner liner and outer wall.

The structural reinforcement is typically a localized reinforcement and does not extend beyond the localized areas to be reinforced. Hence, for heavily loaded pull out drawers utilized in bottom mount refrigerators such local structural reinforcement is not usually sufficient for a refrigerator having a plastic liner. There is a need for reinforcement beyond localized reinforcement.

SUMMARY OF THE INVENTION

The present invention relates to a refrigerator appliance having a pull out drawer or door mounted by guide rails to a refrigerator cabinet for closing an open front portion of the refrigerator cabinet. The refrigerator has a closed loop reinforcing assembly that maintains the structural integrity of the cabinet and drawer for loads carried by the guide rails. The closed reinforcing assembly includes a cabinet liner reinforcement assembly mounted within the refrigerator cabinet that co-operates with a drawer reinforcing brace assembly mounted within the refrigerator drawer.

The reinforcing bracket assembly is located within the cavity of the insulated cabinet and has side reinforcing portions extending along the liner side walls adjacent a corresponding one of the guide rails. The side reinforcing portions are mounted to both the cabinet liner side wall and the guide rails by fasteners passing through the guide rails and liner side walls. The side reinforcing portions are local reinforcement to the liner side walls adjacent the guide rails. The reinforcing bracket assembly, additionally has a rear wall arm extending orthogonal from the respective side reinforcing portions adjacent to and, preferably in contact with, an inside surface of the rear wall of the interior liner. The rear wall arm interconnects and reinforces the side reinforcing portions to structurally support the liner side walls of the liner from flexing outwardly from each other adjacent the guide rails. The interconnection of the side reinforcing portions by the rear wall arm structural liner and cabinet reinforcement beyond local reinforcement.

The reinforcing brace of the closed reinforcing assembly is secured within the drawer at least partially extending across the width of the drawer. The reinforcing brace is connected to the guide rails at end portions thereof to complete a closed reinforcing structure extending around the cabinet liner and across the drawer liner. In addition to providing local support, the closed reinforcing assembly or structure provides a box-like reinforcement able to support loads carried by the guide rails in addition to the load of the drawer.

The reinforcing bracket assembly provides local reinforcement of the liner side walls of the cabinet to support the guide rails mounted thereto. The reinforcement is further enhanced by the reinforcing bracket assembly when it is foamed in place. Additionally, the interconnection of the side reinforcing portions by the rear wall arm structurally supports the liner side walls from flexing inwardly and outwardly and prevents the transfer of stresses related to the opening of the drawer under predetermined load conditions which stresses would otherwise lead to the liner cracking.

In accordance with one aspect of the present invention, the reinforcing bracket assembly is located within the cavity of the refrigerator cabinet and has side reinforcing portions extending along the liner side walls adjacent a corresponding one of the guide rails. The side reinforcing portions are mounted to the liner side wall by fasteners passing through the guide rails and liner side walls. The side reinforcing portions having support flanges extending into and engaging the foam for providing local reinforcement to the liner side walls. The reinforcing bracket assembly has a rear wall arm extending orthogonal from the respective side reinforcing portions adjacent to and, preferably in contact with, the rear wall of the interior liner. The rear wall arm interconnects and reinforces the side reinforcing portions to structurally support the liner side walls of the liner from flexing relative to each other and to thereby prevent stresses from being transferred onto the liner from the pull out drawer when the pull out drawer carries a predetermined load into an open position.

The reinforcing brace of the refrigerator pull out drawer provides localized reinforcement to the drawer in addition to its role in the closed reinforcing assembly. In accordance with one aspect of the invention, the reinforcing brace is secured within the drawer and extends at least partially across the width of the drawer. The brace has two spaced apart members and a cross member connected to and extending between the wing members adjacent an inside surface of the inner liner of the drawer. Each of the wing members has a forward central portion and recessed opposing wing end portions extending from the forward central portion and secured within the drawer. One of the cross member and the forward central portion has an outward facing surface positioned across a corresponding one of spaced apart mounting support apertures located in the inner liner of the drawer. The wing members and the cross member are adapted for securement with a corresponding drawer mounting bracket at the outward facing surface.

BRIEF DESCRIPTION OF THE DRAWINGS

For a better understanding of the nature and objects of the present invention, reference may be had to the accompanying diagrammatic drawings in which.

DETAILED DESCRIPTION OF THE PREFERRED EMBODIMENT

Figure 1:
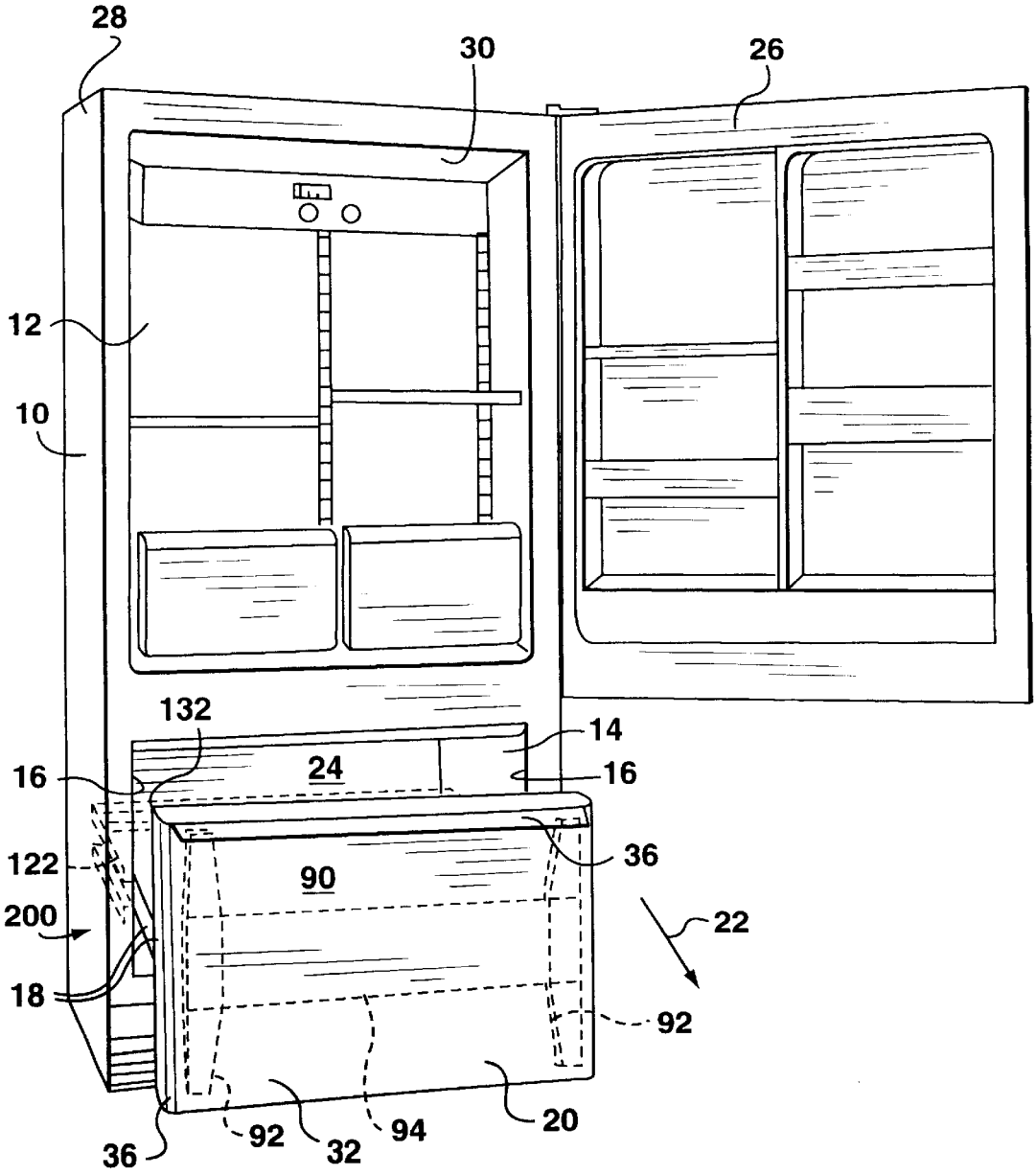
FIG. 1 is a front perspective view of a bottom mount refrigerator having a pull out drawer showing the closed reinforcing assembly of the present invention.

In FIG. 1, a bottom mount refrigerator appliance has a cabinet 10 that has an upper fresh food compartment 12, closed by door 26, and a lower freezer compartment 14. The lower food or freezer compartment 14 has opposing liner side walls 16 to which are mounted telescopic guide rails 18 for supporting pull out drawer 20. In FIG. 1 the pull out drawer 20 is pulled in direction of arrow 22 to the open position shown where the drawer 20 extends across and is spaced forwardly of the open front 24 of compartment 14.

It should be understood that the insulated cabinet 10 typically comprises a metal outer panel or shell 28 of a thin gauge of steel and an inner liner 30 which is spaced from the metal shell by insulation (not shown in FIG. 1). The insulation is typically a foamed in place polyurethane insulation which expands to fill the gap between the outer shell 28 and inner liner 30. The cabinet inner liner 30 may be either metal or plastic and in this preferred embodiment is plastic.

Figure 3:
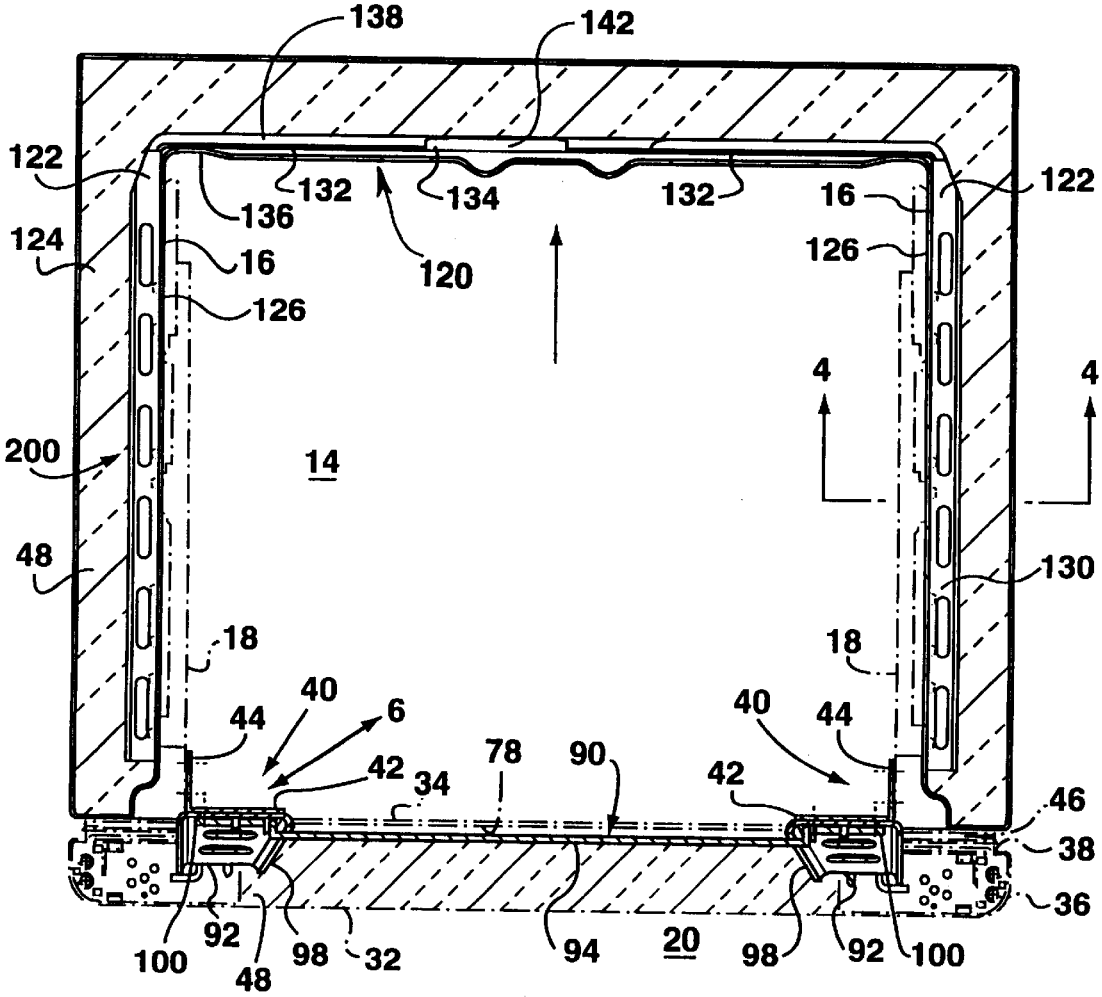
FIG. 3 is a plan sectional view of the refrigerator of FIG. 1
Figure 4:
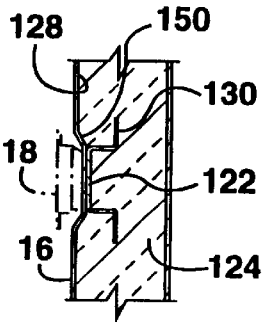
FIG. 4 is a sectional view taken at section 4—4 of FIG. 3.

The lower pull-out drawer 20 also comprises an outer metal panel or shell 32 and a drawer inner liner 34 (FIG. 3). The drawer liner 34 typically comprises a plastic material.

Figure 6:
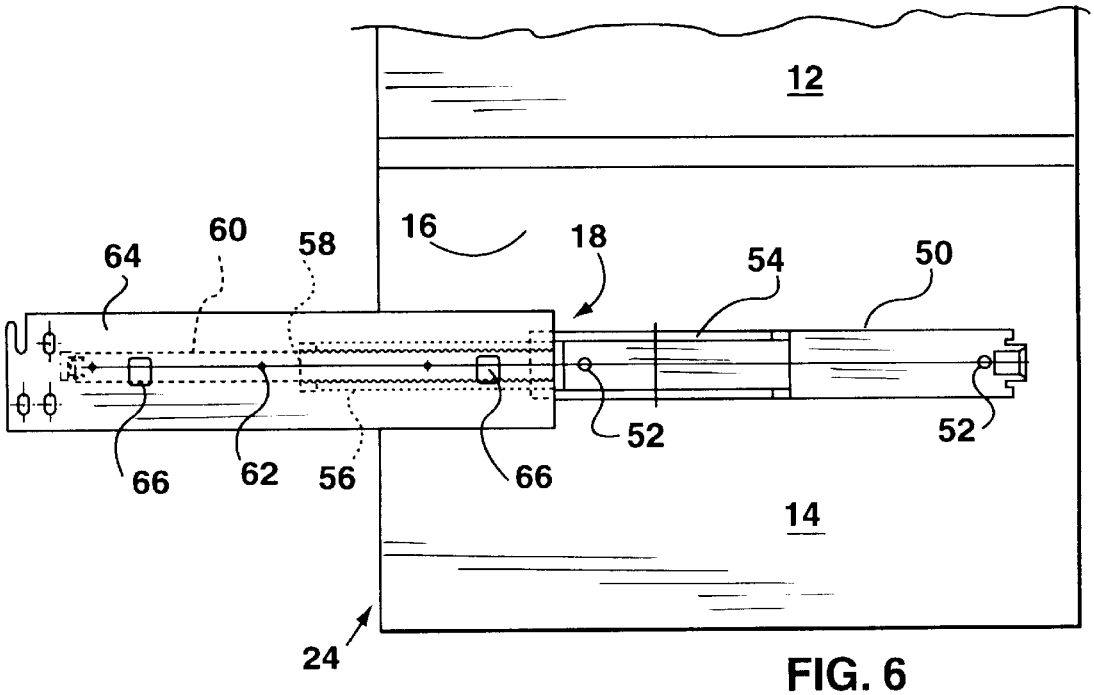
FIGS. 6 and 7 are respectively side and partial perspective views of the guide rail assembly of the present invention.

Referring to FIGS. 1 to 3, 6 and 7 the drawer 20 is mounted with its inner liner 34 facing the open front 24 of the lower food compartment 14 by mounting brackets 40 and telescopic guide rails 18. The telescopic guide rails 18 comprise two opposing telescopic guide rails 18 mounted to a respective one of the opposing liner side walls 16 of the freezer compartment 14. The guide rails 18 as shown in FIG. 6, comprise a stationary portion 50 mounted by screws 52 to the liner side wall 16 of compartment 14. The stationary guide rails 50 each include a U-shaped bracket portion 54 at a forward end thereof adjacent the opening 24 of the compartment 14. The U-shaped bracket portion 54 of the stationary guide rail 50 receives an extending intermediate U-shaped guide bracket 56 that is adapted to slide within the U-shaped 54 of the stationary guide rail 50. The intermediate bracket 56 carries along it's central portion 58 a bar shaped rail 60 which is positioned and secured within the bracket 56. The rail 60 is attached by rivets 62 to a first rail end bracket 64. As shown in FIG. 6, the first telescopic guide rail 18 is fully extended such that the first rail end bracket 64 extends through the open front 24 of the lower food compartment 14. The first rail end bracket further has tabs 66 which extend inwardly and upwardly towards the interior of the food compartment 14 when the guide rail 64 is recessed directly within the compartment 14. To effect this, the intermediate bracket or rail portion 56 slides within the bracket 54 bringing the first end bracket 64 back within the open front 24 of the compartment 14.

Figure 8:
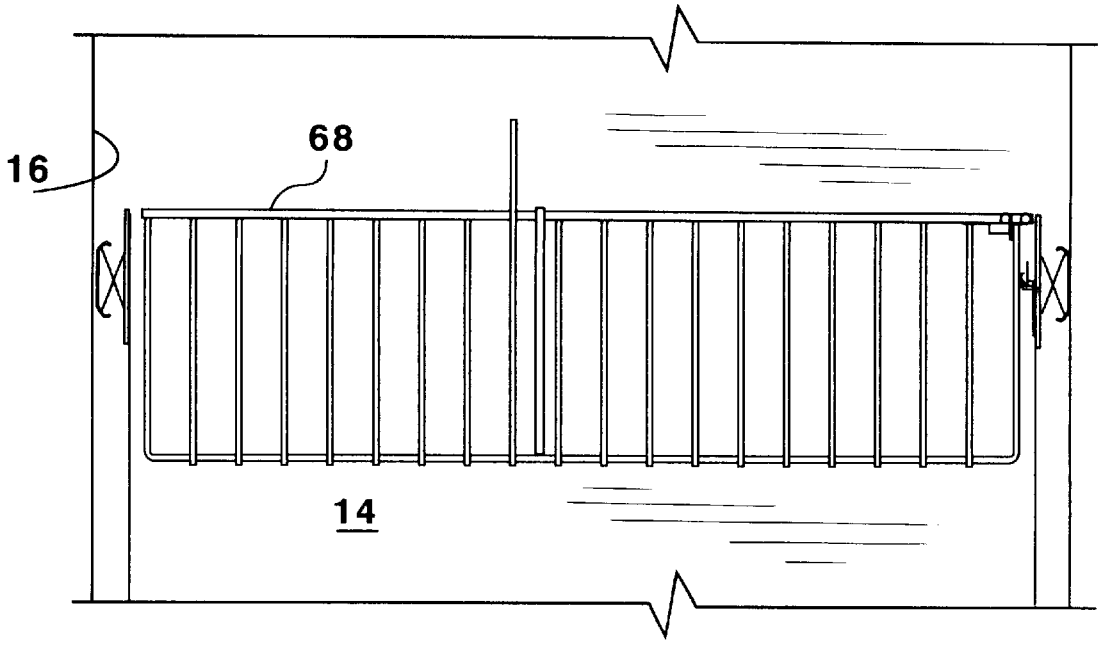
FIGS. 8 and 9 are diagrammatic views showing the mounting of the drawer container basket to the guide rails.
Figure 9:
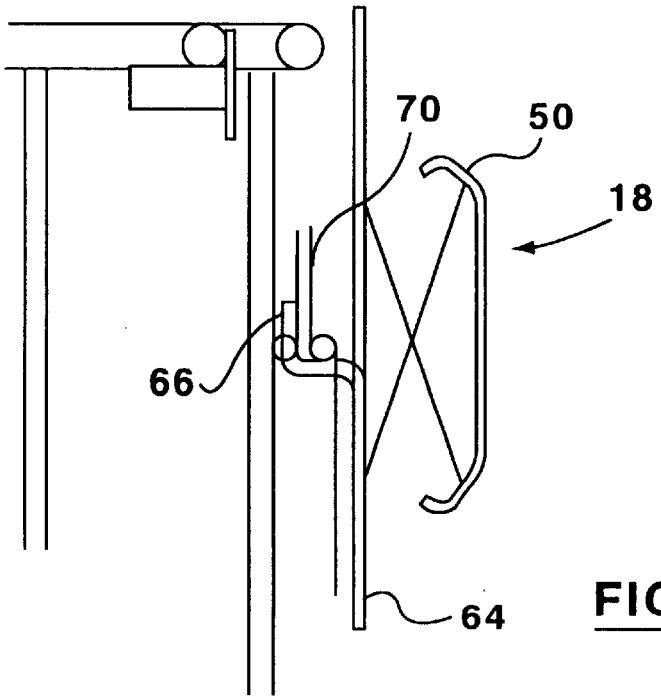

As shown in FIGS. 1, 8, and 9, a basket 68 extends between the guide rails 18 and has a shoulder or side arm supporting portion 70 that passes over and extends along the liner side walls 16 and is seated upon both of the tab members 66. The telescopic rails 18 support the basket 68 for supporting food articles.

Figure 2:
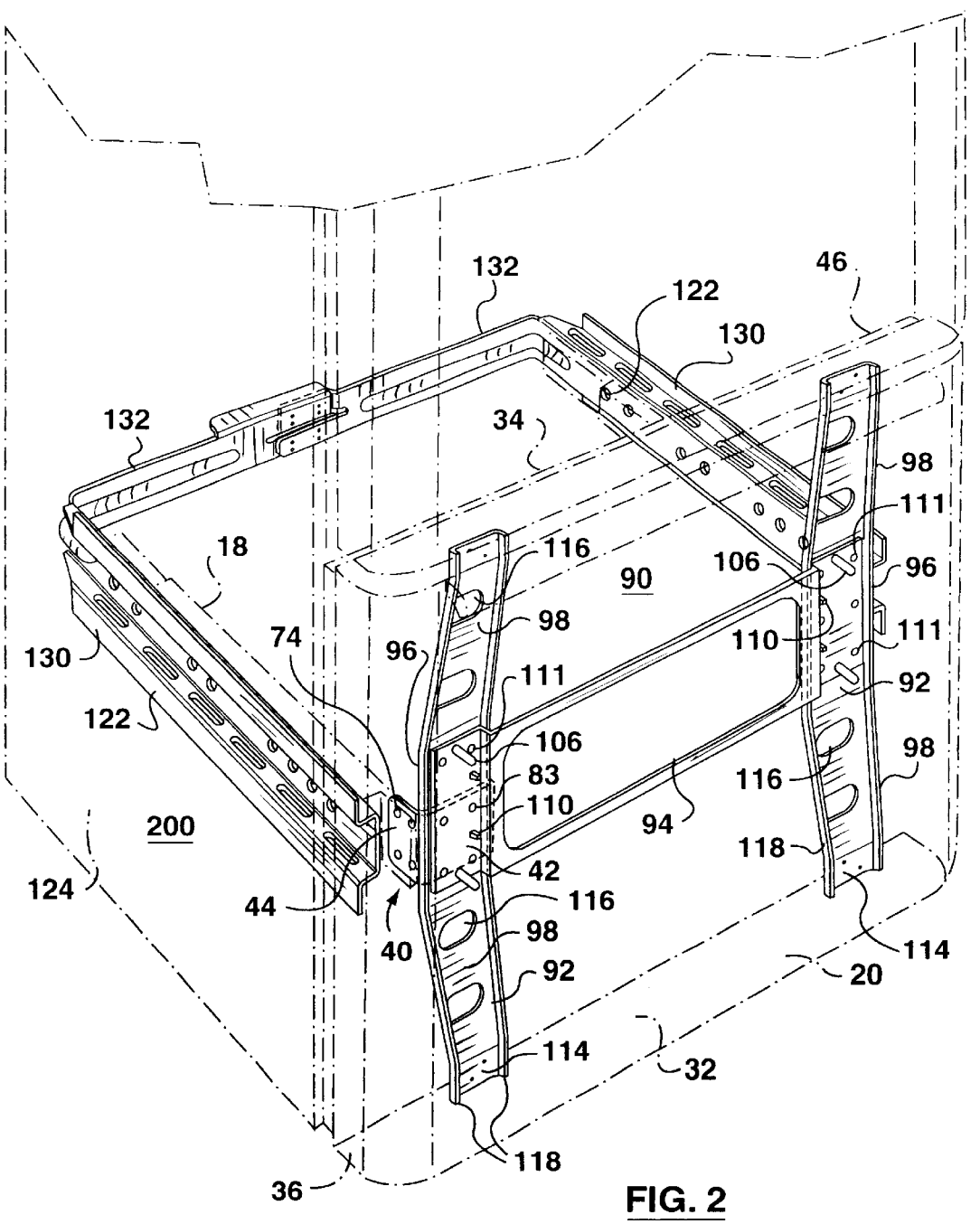
FIG. 2 is a perspective view showing the closed reinforcing assembly of the present invention in more detail.
Figure 5:
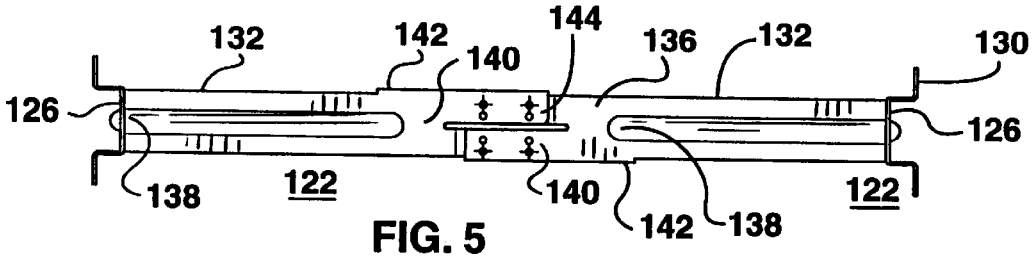
FIG. 5 a end view of the reinforcing bracket assembly of the present invention.
Figure 7:
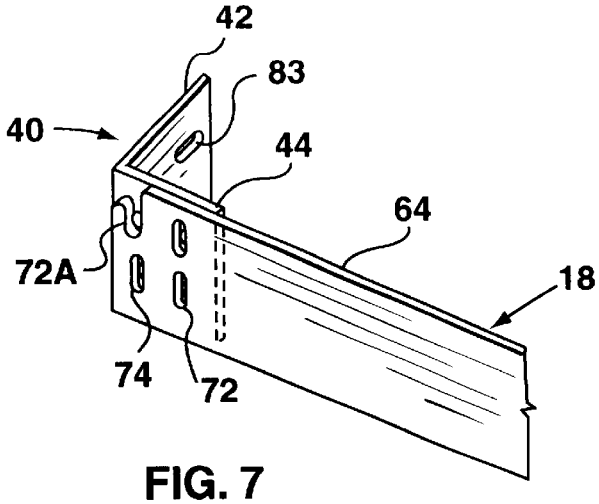

To secure the drawer 20 to the guide rails 18, a pair of mounting brackets 40 are used. In FIGS. 2, 3, and 7, one of the mounting brackets 40 is shown to comprise a front plate 42 and a side plate 44. The front plate 42 is positioned at right angles relative to the side plate 44. The mounting brackets 40 comprise a steel material having a thickness in the order of ⅛ of an inch. The side plate 44 is secured to the first end rail 64. The first end rail 64 includes four apertures 72, 72A. Three apertures 72 are shown for the rail 64. The side plate 44 of the mounting bracket includes four apertures 74. The apertures 74 align with the apertures 72 by placing the side plate 44 flush against the first end rail 64. Thereafter, a fastener in the form of a threaded screw (not shown) is passed through the aligned apertures and has a head for engaging the outside of the first rail 64.

The brackets 40 are mounted to the inner liner 34 of the drawer 20 by the front plate 42. The front plate 42 has a series of apertures 83 throughwhich fasteners (not shown) pass to mount drawer 20 to bracket 40 and thus to guide rails 18.

Figure 10:
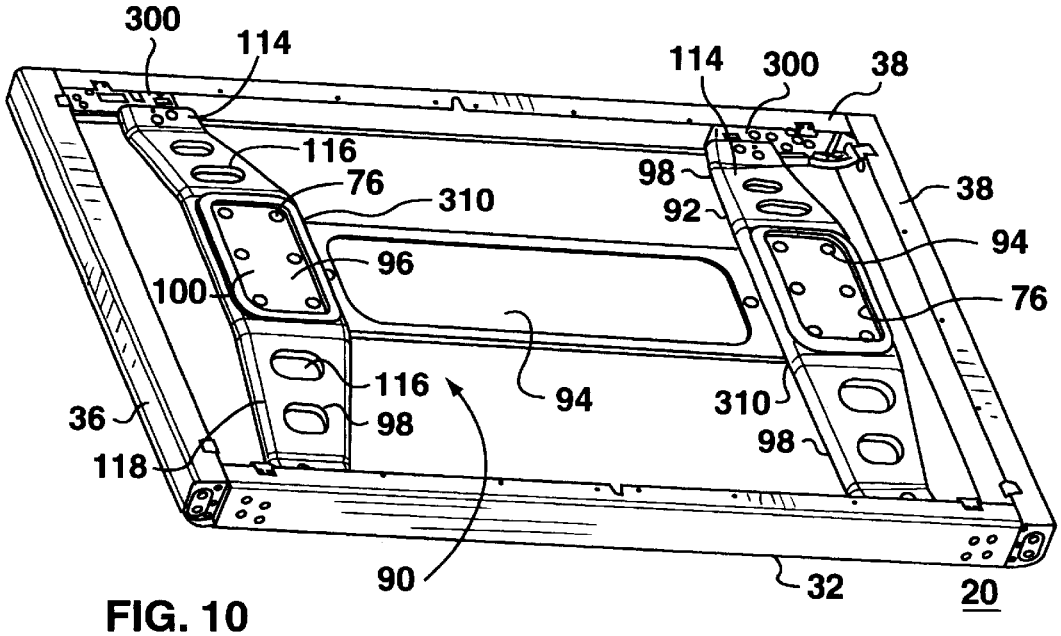
FIG. 10 is perspective view of the brace assembly and refrigerator drawer of the present invention.

Referring to FIGS. 1, 2, 3, 10 and 11, the drawer 20 is a pull out drawer or door that is pulled out horizontally from the cabinet 10 in the direction of arrow 22. The pull out drawer 20 comprises outer drawer panel 32 having a generally flat metal sheet with rearwardly extending side walls 36 and in-turned flanges 38 extending generally parallel to the flat sheet 32. The inner drawer liner 34 comprises a plastic liner having a peripheral flange 46 secured with the in-turned flanges 38 of the outer drawer panel 32. Foam insulation 48 is foamed in place between the inner drawer liner 34 and the outer drawer panel 32. The inner drawer liner 34 has two spaced apart mounting support apertures 76 as best seen in FIG. 10.

In accordance with an aspect of the present invention, a reinforcing brace 90 is secured within the drawer 20 extending at least partially across the width of the drawer 20. The brace 90 has two spaced apart wing members 92 and a cross member 94 connected to and extending between the wing members 92 adjacent an inside surface of the drawer inner liner 34. The wing members 92 may comprise a metal plate and in the preferred embodiment are made from a glass reinforced nylon.

Referring to FIGS. 2, 3, 10 and 11 the wing members 92 have a forward central portion 96 and recessed opposing wing end portions 98 extending from the forward central portion 96 and secured within the drawer 20. The forward central portion 96 has an outward facing surface 100 positioned across a corresponding one of the spaced apart mounting support apertures 76 that is substantially flush with the inner drawer liner 34 for securement with a corresponding drawer mounting bracket 40. A gasket 310 (FIG. 10) surrounds the periphery of the mounting support aperture 76 and is placed on the outward facing surface 100. Gasket 310 acts as a seal for the inner drawer liner 34 and the outward facing surface 100. Gasket 310 may also provide a cushion for supporting the door mounting brackets.

The cross member 94 comprises a substantially rectangular frame having two side portions 102 overlapping the central portions 96 of each wing member 92. The central portions 96 of the wing members 92 has an inside surface 104 that has posts 106 extending into the drawer 20 and the cross member 94 has side portions 102 with first corresponding apertures 108 throughwhich the posts extend to locate the cross member relative to the wing members 92 prior to foaming insulation into the drawer cavity. Further, each of the central portions 96 of the wing members 92 has tabs 110 with barbs extending into the drawer 20 and the side portions 102 of the cross member 94 has second corresponding apertures 112 throughwhich the tabs 110 extend to locate and lock the cross member 94 relative to the wing members 92.

The central portions 96 of the wing members 92 and side portions 102 of the cross member 94 overlapping the central portions 96 have aligned apertures 111 for receiving bracket mounting fasteners (not shown) passing through brackets 40 and brace 90.

Figure 12:
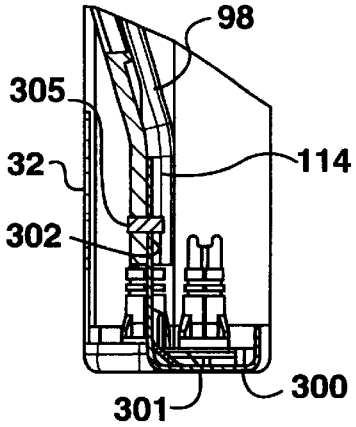
FIG. 12 is a partial sectional view showing the corner bracket mounting of the terminal end portion of the wing member to the outer panel of the drawer.
Figure 11:
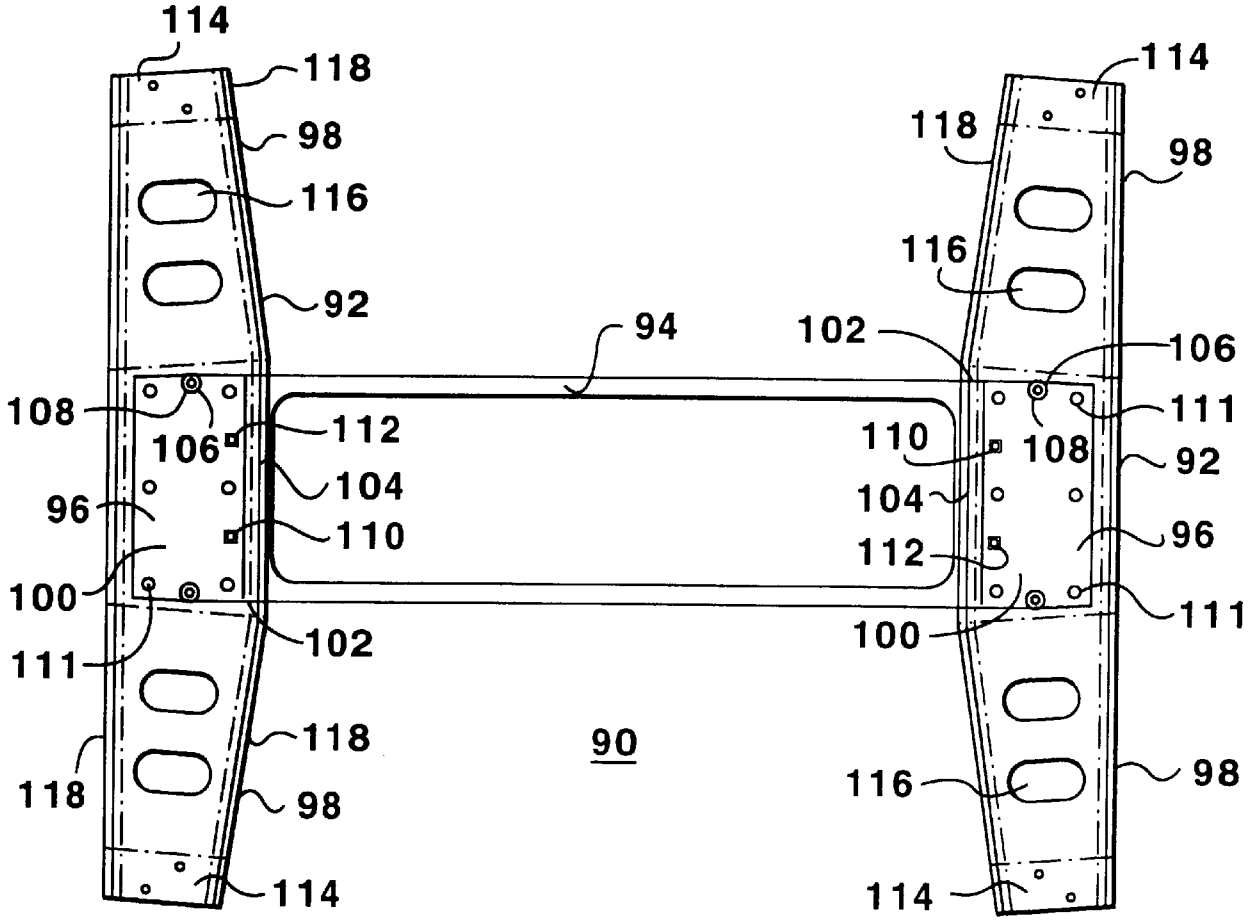
FIG. 11 is a end view of the brace assembly of the present invention.

Each of the recessed wing end portions 98 slopes into the drawer 20 away from the inner liner 34 at an angle which varies depending on the drawer height. The wing end portions 98 have terminal end portions 114 that preferably extend parallel to the central portion 96. The wing end portions include apertures 116 and side flanges 118 for improving rigidity and formation with the foam when foamed into the drawer 20. The terminal end portion 114 is secured with the outer panel 32 of the drawer 20. The terminal end portion 114 is preferably secured with the outer panel 32 of the drawer 20 through a corner support bracket 300 (FIGS. 10 and 12). The bracket 300 has a first portion 302 extending adjacent the terminal end portions 114 of the wing member and secured thereto by stud fastener 305. The bracket 300 has a base support portion 301 that extends at right angles to portion 302 and is secured against an inside surface of a side wall of the outer drawer panel 32.

The brace 90 so mounted and foamed in place within drawer 20 provides a local drawer reinforcing structure that is able to distribute drawer 20 loading forces across the drawer 20 away from and independent of the drawer liner 34. The brace 92 is able to connect at the wing number central portions 96 directly to brackets 40 through aperture 76 in the drawer liner 34 without placing a load on the drawer liner 34.

In accordance with another aspect of the present invention, the refrigerator cabinet 10 has a reinforced drawer guide rail support assembly 120 as shown in FIGS. 1 to 5. The reinforced drawer guide rail assembly 120 comprises the pair of telescopically extendable drawer supporting guide rails 18 as described previously each mounted to one of the opposing liner side walls 16 and to the insulated drawer 20 such that the drawer 20 slides into a sealing engagement with the cabinet 10 across the open front 24 when the drawer 20 is closed.

The reinforced guide rail support assembly 120 includes a pair of reinforcing bracket members 122 located within the cavity 124 defined between cabinet outer panel 28 and liner 30. The bracket members 122, each have a side reinforcing portion 126 extending along the liner side wall 16 adjacent a corresponding one of the guide rails 18 and mounted to an inside surface 128 of the liner side wall 116 by fasteners 52 passing through the guide rails 18 and liner side walls 16. The side reinforcing portions 126 have support flanges 130 extending into and engaging the foam 48 for providing local reinforcement to the liner side walls 16.

The reinforcing bracket members 122 each have a rear wall portion 132 extending orthogonal from the respective side reinforcing portions 126 adjacent to and in contact with the rear wall 134 of the cabinet interior liner 30. The rear wall portions 132 are secured to each other to form a continuous arm 132 interconnecting and reinforcing the side reinforcing portions 126 to structurally support the liner side walls 16 of the liner 30 and from flexing outwardly or inwardly from each other adjacent the guide rails 18. At the same time, this feature prevents load or stress transfer to the plastic liner.

Each of the rear wall portions 132 has a flat surface 136 adapted to rest against the rear wall 134 of the inner liner 30 and a rib 138 extending into the cavity 124 to strengthen the rear wall portion 132. Each of the rear wall portions 132 has overlapping end portions 140 with flanges 142 extending into the cavity 134 to positively locate the end portions 140. The overlapping end portions 140 have apertures 144 for receiving fasteners (not shown) to secure the overlapping end portions 140 in fixed relation to each other.

The reinforced drawer guide rail support assembly 120 further includes a pair of opposed recessed liner slots 150 (FIG. 4) each extending horizontally along a corresponding one of the opposing liner side walls 16. Each of the telescopically extendable guide rails 18 preferably comprises three arms, two of which extend telescopically and a third arm which is mounted within the liner slots 150 to one of the opposing liner side walls 16 and to the side reinforcing portions 126 located in the cavity 124.

In accordance with another aspect of the present invention, the closed reinforcing assembly 200 comprises the combination of the assemblies described hereinabove for the preferred embodiment. That is to say, the closed reinforcing assembly 200 comprises:

the reinforcing brace 90 secured within the drawer 20, a pair of telescopically extendable guide rails 18 each mounted to one of the opposing liner side walls 16 and each having a first rail end 64 adjacent the open front 24 when the drawer 20 is closed and passing through the open front 24 when the drawer 20 is open, the pair of reinforcing bracket members 122 located within the cavity 124, the pair of mounting brackets 40 for mounting the insulated drawer 20 to the side rails 18 such that the drawer 20 slides into a sealing engagement with the cabinet 10 across the open front 24 when the drawer 20 is closed, the mounting brackets 40 each having a side plate 44 secured by at least one first fastener means to the first rail end 64 of a corresponding one of the pair of guide rails 18, and a front plate 42 secured by at least one second fastener means against a corresponding one of the wing members 92 adjacent the drawer mounting bracket aperture 76, the closed reinforcing assembly comprising the reinforcing brackets 122, the guide rails 18 and the reinforcing brace 92, maintains the structural integrity of the cabinet 10 and drawer 20 for loads carried by the guide rails 18.

During drawer manufacture, it should be understood that the insulation may be formed into a completed drawer so as to adhere to inside surfaces of the inner drawer liner and the outer drawer panel. Preferably, the insulation is foamed into a partially completed drawer comprising the outer drawer panel and the reinforcing bracket assembly of the present invention. Subsequently, the drawer liner is attached to the outer drawer panel to complete the drawer assembly.

Certain preferred embodiments of the invention have been described in detail. From a reading of this disclosure, obvious modifications will be evident to those skilled in the art without departing from the spirit of the invention disclosed or from the scope of the appended claims.

What we claim is:

1. A pull out drawer for closing an open front of a refrigerator appliance comprising:

an outer drawer panel;

an inner drawer liner secured to the outer drawer panel, the inner drawer liner having two spaced apart mounting support apertures;

a reinforcing brace secured within the drawer extending at least partially across the width of the drawer and having two spaced apart wing members and a cross member connected to and extending between the wing members adjacent an inside surface of the inner liner;

each of the wing members having a forward central portion and recessed opposing wing end portions extending from the forward central portion and secured within the drawer, one of the cross member and the forward central portions of the wing members having outward facing surfaces each positioned across a corresponding one of the spaced apart mounting support apertures for securement with a corresponding drawer mounting bracket, and insulation positioned between the inner drawer liner and the outer drawer panel.

2. The drawer of claim 1 wherein each outward facing surface is substantially flush with the inner drawer liner.

3. The drawer of claim 1 wherein each central portion of the wing members have an inside surface adapted to position the cross member relative thereto prior to positioning the insulation.

4. The drawer of claim 3 wherein each central portion of the wing members has posts extending into the drawer, and the cross member has side portions with first corresponding apertures throughwhich the posts extend to locate the cross member relative to the wing members.

5. The drawer of claim 4 wherein each central position of the wing members has tabs with barbs extending into the drawer, and the side portions of the cross member has second corresponding apertures throughwhich the tabs extend to locate and lock the cross member relative to the wing members.

6. The drawer of claim 3 wherein each central position of the wing members and side portions of the cross member overlapping the central portions have aligned apertures for receiving bracket mounting fasteners.

7. The drawer of claim 1 wherein the cross member comprises a substantially rectangular frame having two side portions overlapping the central portion of each wing member.

8. The drawer of claim 7 wherein each central portion of the wing members has posts extending into the drawer, and the side portions of the cross member have first corresponding apertures throughwhich the posts extend to locate the cross member relative to the wing members.

9. The drawer of claim 8 wherein each central position of the wing members has tabs with barbs extending into the drawer, and the side portions of the cross member have second corresponding apertures throughwhich the barbs extend to locate and lock the cross member relative to the wing members.

10. The drawer of claim 9 wherein each central portion of the wing members and side portions of the cross member overlapping the central portions have aligned apertures for receiving bracket mounting fasteners.

11. The drawer of claim 7 wherein each central position of the wing members and side portions of the cross member overlapping the central portions have aligned apertures for receiving bracket mounting fasteners.

12. The drawer of claim 11 wherein each of the recessed wing end portions slope into the drawer away from the inner liner and is surrounded by insulation.

13. The drawer of claim 12 wherein each of the wing end portions has a terminal end portion secured with the outer panel of the drawer through a corner support bracket.

14. The drawer of claim 12 wherein the wing end portions include apertures and side flanges for improving formation within the drawer with the insulation.

15. The drawer of claim 14 wherein the wing members comprise a glass reinforced nylon.

16. The drawer of claim 7 wherein a gasket extends around each of the peripheries of the mounting support apertures to seal the inner drawer liner to the outward facing surface.

17. The drawer of claim 7 wherein the insulation is foamed in place insulation that adheres to the inner drawer liner.

18. The drawer of claim 7 wherein the insulation is foamed in place and does not adhere to the inner drawer liner.

19. The drawer of claim 1 wherein each of the recessed wing end portions slop into the drawer away from the inner liner and is surrounded by insulation.

20. The drawer of claim 19 wherein each of the wing end portions has a terminal end portion secured with the outer panel of the drawer.

21. The drawer of claim 19 wherein the wing end portions include apertures, and side flanges for improving formation within the drawer with the insulation.

22. The drawer of claim 21 wherein the wing members comprise a glass reinforced nylon.

23. The drawer of claim 1 wherein a gasket extends around each of the peripheries of the mounting support apertures to seal the inner drawer liner to the outward facing surface.

24. The drawer of claim 1 wherein the insulation is foamed in place insulation that adheres to the inner drawer liner.

25. The drawer of claim 1 wherein the insulation is foamed in place and does not adhere to the inner drawer liner.

26. The drawer of claim 1 wherein outer drawer panel comprises a generally flat metal sheet with rearwardly extending side walls and in-turned flanges extending generally parallel to the flat sheet and wherein the inner drawer liner comprises a plastic liner having a peripheral flange secured with the in-turned flanges of the outer drawer panel.

* * * * *